US005231735A

United States Patent [19]

Paxton

[11] Patent Number: 5,231,735

[45] Date of Patent: Aug. 3, 1993

[54] CLIP FOR CLOSING THE FOLDED END OF A FLEXIBLE BAG

[76] Inventor: Jerre H. Paxton, 2720 S. 16th Ave., Yakima, Wash. 98903

[21] Appl. No.: 864,209

[22] Filed: Apr. 3, 1992

Related U.S. Application Data

[63] Continuation of Ser. No. 731,746, Jul. 16, 1991, abandoned.

[51] Int. Cl.[5] ..... B65D 77/10

[52] U.S. Cl. ..... 24/30.5 S; 24/563

[58] Field of Search ..... 24/30.5 R, 30.5 S, 30.5 P, 24/30.5 L, 67.9, 530, 532, 563

[56] References Cited

U.S. PATENT DOCUMENTS

| | | | |
|---|---|---|---|
| 819,504 | 5/1906 | Benedict | 24/67.9 |
| 873,099 | 12/1907 | Shepard et al. . | |
| 1,345,713 | 7/1920 | Stevens . | |
| 1,878,861 | 9/1932 | Krasnow . | |
| 2,341,121 | 2/1944 | Schaaff | 24/259 |
| 2,533,539 | 12/1950 | Vivian | 229/65 |
| 2,643,046 | 6/1953 | Humphreys | 229/6 |
| 2,717,572 | 9/1955 | Kingmem | 24/67.9 X |
| 2,824,350 | 2/1958 | Lee | 24/137 |
| 3,084,407 | 4/1963 | Settles | 24/3 R |
| 3,131,445 | 5/1964 | Lorber . | |
| 3,348,272 | 10/1967 | Germani | 24/137 |
| 3,373,742 | 3/1968 | Shears et al. | 128/171 |
| 4,911,293 | 3/1990 | Holmes | 206/343 |

FOREIGN PATENT DOCUMENTS

| | | | |
|---|---|---|---|
| 923174 | 6/1947 | Belgium | 24/67.9 |
| 539892 | 8/1955 | Belgium . | |
| 123106 | 3/1878 | France . | |
| 1489764 | 7/1967 | France . | |
| 360971 | 5/1962 | Switzerland | 24/67.9 |
| 425731 | 3/1935 | United Kingdom . | |
| 584761 | 1/1947 | United Kingdom . | |

*Primary Examiner*—James R. Brittain
*Attorney, Agent, or Firm*—Seed and Berry

[57] ABSTRACT

A flat plastic clip has a pressure tab having opposed sharp pressure points facing the thin, narrow pinching channels. The pressure points are joined by curved hook portions and partially form bag crease openings that are offset inwardly from the pressure points. A large relief opening is provided below the pressure tab and joins pinching channels adjacent the pressure points. The width of the material of the body between the outside end of the body and the pressure pinching channels is of considerable width. The neck of the pressure tab which joins the pressure tab to the body is also of substantial width to provide rigidity to the clip at the pinching channels and apply a strong force resisting bending of the pressure tab outwardly of the plane of the clip.

8 Claims, 2 Drawing Sheets

FIG. 1
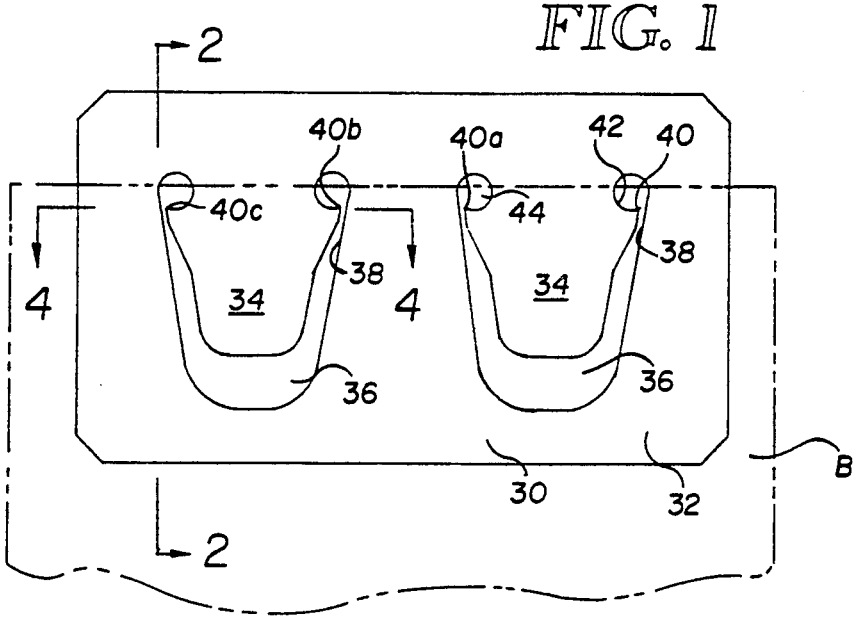
FIG. 2
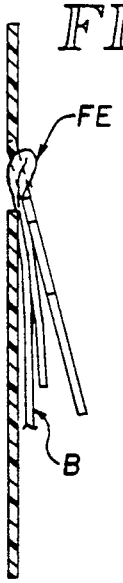
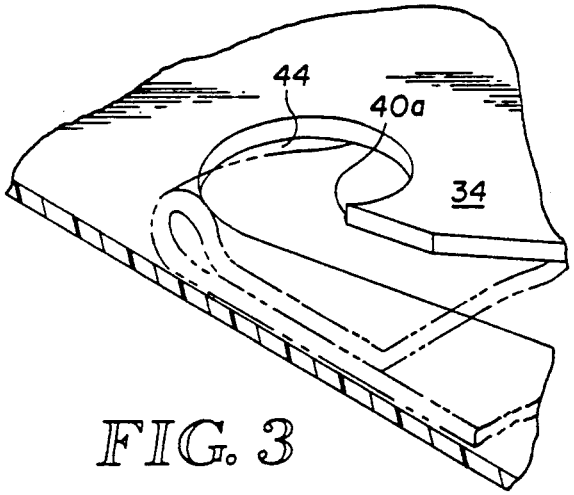
FIG. 3
FIG. 4
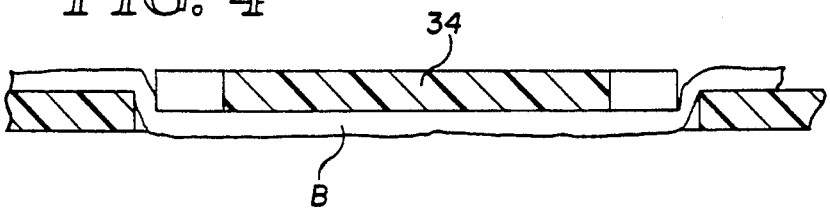

CLIP FOR CLOSING THE FOLDED END OF A FLEXIBLE BAG

CROSS-REFERENCE TO RELATED APPLICATION

This application is a continuation of U.S. application Ser. No. 07/731,746, filed Jul. 16, 1991, now abandoned.

TECHNICAL FIELD

This invention pertains to bag-closing clips of the type that clasp over the folded end of a bag to hold the bag closed.

BACKGROUND OF THE INVENTION

Heretofore, plastic bag-closing clips have generally fit around the twisted or gathered neck of a bag to hold the bag closed.

Other types of clips have held a smoothly joined or folded bag end by pinching the bag closed. Typical closures of these type are shown in U.S. Pat. No. 2,533,539. Other closures for holding the folded end of a bag closed are in the shape of large clothespins using a spring clamping pressure for closing the bag.

These spring closing-type closures are expensive to manufacture and bulky.

SUMMARY OF THE INVENTION

It is an object of this invention to provide a clip for closing the folded end of a bag which is inexpensive to manufacture.

It is another object of this invention to provide a plastic closure for closing the folded end of a bag by clasping the folded end of the bag at spaced sharp pressure points applied at narrow pinching channels to firmly grip the bag without inadvertently sliding off.

Basically, these objects are obtained by providing a clip having a flat plastic body with a central pressure tab. The pressure tab terminates at opposite ends in sharp pressure points that are adjacent narrow pinching channels. These pressure points press the folded end of the bag tightly against the opposed side of the channels while providing firm gripping pressure on the bag. Preferably, the areas above the pinching points are relieved as crease-receiving openings that are centrally offset inwardly from the pressure points. Also preferably, the pinching channels join an enlarged relief opening below the pressure tab for holding the bag material and allowing it to flow beneath the pressure tab without applying undue bending pressure on the pressure tab.

Using a clip of this configuration applies the sharp pressure points in narrow, confined pinching channels on opposite sides of the pressure tab. The relief openings then relieve pressure on the pressure tab so that the clamping pressure can be increased at the pressure points. This causes the folded end of he bag to make sharp turns at the pressure points so that the pressure points engage the material almost perpendicularly to the surface of the material. This applies a tight gripping pressure, making the bag folded end less likely to slide free of the clip.

The clip can be provided with a single pressure tab or, preferably, will be provided with multiple pressure tabs to increase the number of pressure points engaging the material of the folded end of the bag. There can be opposed pressure points at each pinching channel.

BRIEF DESCRIPTION OF THE DRAWINGS

FIG. 1 is a front elevation of a clip for closing the folded end of a bag.

FIG. 2 a section of the clip taken along the line 2—2 of FIG. 1.

FIG. 3 is an enlarged prospective of a portion of the clip shown in FIG. 1.

FIG. 4 is a fragmentary section taken along the line 4—4 of FIG. 1.

DETAILED DESCRIPTION OF THE INVENTION

Figure 5:
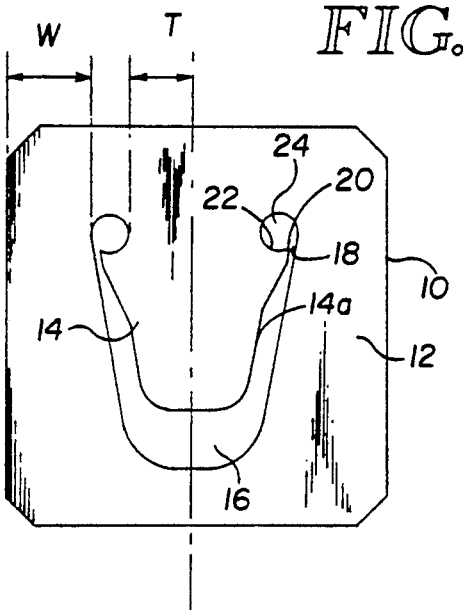
FIG. 5 is a front elevation of a clip having a single pressure tab.

As best shown in FIG. 5, the clip 10 has a flat body 12 having a central pressure tab 14. The pressure tab 14 is formed in the center of an enlarged relief opening 16. The relief opening is symmetrical and joins narrow pinching channels 18 on either side of the pressure tab.

The pressure tab also has sharp, opposed pressure points 20 that have on one side a hook portion 22. The point and hook portion form part of a bag crease opening 24. The center of the bag crease opening is offset inwardly from the pressure point. Since the pressure point, hook portions, and openings are symmetrical in the clip, only one side is described, it being understood that the bag folded end will be inserted beneath the pressure tab and will be engaged by the pressure points 20 in the pinching channels on either side of the pressure tab.

The pinching channels are most narrow or of most reduced width at the area immediately opposite the pressure points and then are wider or of a greater width in the area beyond or below the pressure points toward the free end 14*a* of the pressure tab. The greater width area provides relief for the fold of the bag to lie along side the pressure tab in the channels below the tab without overly bending the tab thus allowing the pressure points to press tightly against the fold of the bag to hold the clip onto the folded end of the bag.

FIG. 1 shows a clip having a flat body 32, a pair of pressure tabs 34 each having a central relief opening 36 joined to pinching channels 38. The central tab has a pair of sharp pressure points 40, each having an adjacent hook portion 42 partially defining a crease opening 44. The center of the crease opening is offset inwardly from the pressure point. In this embodiment, the pressure tabs, pressure points, pinching channels, and relief openings are duplicated at a second location on the body 32 and will apply four pressure points, as at 40, 40*a*, 40*b*, and 40*c*. With four pressure points, the gripping is synergistically improved over merely two pressure points, and the combined four points provide a total gripping action more than double the gripping of a single pressure tab, as in FIG. 5.

FIG. 2 shows how the folded end FE of the bag B lies under the pressure tab 34. The width w, shown in FIG. 5, for example, must be substantial and approximately equal to or greater than the width t, also shown in FIG. 5. These substantial widths provide the pressure tab and the plastic material around the pressure tab with considerable rigidity. This rigidity causes the pressure tab 34 to be very resistant to bending outwardly as the folded end of the bag is slid under the tab. In addition, the crease openings 24 relieve the pressure on the tab caused by the thickness of the crease, again causing the tab to not deflect very much out of the plane of the body 12. The large relief opening 36 at the bottom of the tab provides a substantial opening for allowing the bag to bend and move out from beneath the tab so that, again, not a great amount of bending pressure is applied to flex the tab outwardly.

In contrast to these large relief openings, the pressure points apply their pressure at very narrow channels 18. This enables the pressure points to apply considerable pressure almost at right angles to the face of the folded end of the bag material. The application of these forces at almost right angles causes the pressure points to dig in tightly to keep the clip on the bag.

The offset of the center of the crease openings inwardly from the pressure points allows the bag material to be gathered into the openings and again reduces the amount of pressure trying to push the stiff pressure tab out of the plane of the body.

Figure 6:
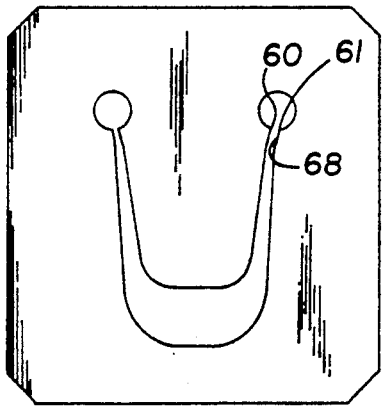
FIG. 6 is another embodiment of the invention.

FIG. 6 illustrates an embodiment in which two sets of pressure points 60 and 61 are provided at each pinching channel 68.

While the preferred form of the invention has been illustrated and described, it should be apparent that variations will be apparent to one of ordinary skill in the art. Accordingly, the invention is not to be limited to the specific embodiment shown in the drawings.

I claim:

1. A clip for holding closed a folded end of a flexible bag comprising:

a flat planar plastic body;

a set of bag crease openings spaced across said body and each having a center line; and a pressure tab joined to said body in an enlarged relief opening and between said crease openings and having a center line extending generally parallel to the center lines of the bag crease openings, said pressure tab having laterally outwardly spaced pressure points facing laterally outwardly opposite from one another, said pressure points each joined at one side to a hook surface and terminating at the opposite side in a pinching channel, said pressure tab in an undeflected condition being uniformly flat across its width from one pressure point and pinching channel being offset laterally outwardly from the center line of the adjacent said bag crease tab, with the crease of the folded end received in said bag crease openings and bending around the pressure points in said pinching channels.

2. A clip for holding closed a folded end of a flexible bag, comprising:

a flat plastic body, said body having a central pressure tab in an enlarged relief opening and having a movable terminal end; and means on said tab for applying pressure at transversely spaced locations on either side of said pressure tab, said means for applying pressure including sharp pressure points directed toward channels of reduced width wherein the folded end of the bag is griped at two points on opposite sides of said pressure tab within said reduced width channels, said channels having a most narrow width in an area opposite the pressure points and extending from a location adjacent the pressure points and within the half of the channel adjacent the pressure points lengthwise to the terminal end of the pressure tab so as to provide a relief area along the length of the pressure tab for receiving the bag, said means for applying pressure including bag crease-receiving openings spaced above said pressure points, each said bag crease-receiving opening defining a curved hook surface terminating upwardly at said sharp pressure point located above the curved hook surface.

3. The clip of claim 2, said body including a second central pressure tab, and means on said second pressure tab for applying pressure at transversely spaced location on either side of said second pressure tab, said means for applying pressure including pressure points directed outwardly toward pinching channels of reduced width wherein the folded end of the bag is gripped at four points, two sets of points on opposite sides of each of said first and second pressure tabs.

4. The clip of claim 2, said pressure points being on said central pressure tab and directed laterally outwardly, each said bag crease-opening each having a center that is laterally offset inwardly from said adjacent sharp pressure point and channel.

5. A clip for holding closed a folded end of a flexible bag, comprising:

A flat plastic body with front and rear surfaces when in an undeflected condition having each such front and rear surface in a single flat plane, said body having a central pressure tab in an enlarged relief opening; and means on said tab for applying pressure at transversely spaced locations on either side of said pressure tabs, bag crease openings on opposite sides of said central pressure tab and terminating downwardly in pinching channels of reduced width, the pinching channels each having inner and outer sides, the outer side of each channel being straight and elongated, said means for applying pressure including sharp pressure points directed laterally outwardly toward the elongated outer sides of the pinching channels of reduced width, the inner side of each channel diverging downwardly from the outer side below the pressure points in the plane of the tab, the straight elongated outer side of each pinching channel extending above said sharp pressure point and into said bag crease opening wherein the folded end of the bag is gripped at tow points on opposite sides of said pressure tab between said sharp pressure points and the straight elongated outer sides of the pinching channels within said narrow channels, said channels having a most narrow width in an area opposite the pressure points and an area of larger width beyond and adjacent the pressure points toward the free end of the pressure tab, and said pressure tab in an undeflected condition being uniformly flat across its width from one pressure point to the other so that the pressure points lie in the same plane as the remainder of the plastic body.

6. The clip of claim 5, said bag crease-opening each having a center that is laterally inwardly offset from the sharp pressure point and pinching channel adjacent thereto.

7. The clip of claim 5, each said bag crease-opening defining a curved hook surface terminating upwardly at said pressure point above the curved hook surface.

8. A clip for holding closed a folded end of a flexible bag, comprising:

a flat plastic body having forward and rearward surfaces that in an undeflected condition are each in a single flat plane;

a set of bag crease openings spaced across said body, each opening having a center line; and a pressure tab joined to said body in an enlarged relief opening between said crease openings and adapted to fit over the folded end of a flexible bag, said tab having a center line generally parallel to said center lines of said bag crease openings;

said pressure tab having laterally outwardly spaced pressure points facing laterally outwardly opposite from one another, said pressure points each joined at one side to a hook surface and terminating at the opposite side in a pinching channel, said pressure tab in an undeflected condition being uniformly flat across its width from one pressure point to the other so that the pressure points lie in the same plane as the remainder of the plastic body, each said pressure point and pinching channel being offset laterally outwardly from the center line of the adjacent bag crease openings wherein the bag folded end is adapted to fit under the tab, with the crease of the folded end received in said bag crease openings and the folded end of the bag bending around the pressure points in said pinching channels.

* * * * *

UNITED STATES PATENT AND TRADEMARK OFFICE

CERTIFICATE OF CORRECTION

PATENT NO. : 5,231,735

DATED : August 3, 1993

INVENTOR(S) : Jerre H. Paxton

It is certified that error appears in the above-identified patent and that said Letters Patent is hereby corrected as shown below:

In column 3, claim 1, line 43, after "one pressure point" and before "and pinching", please insert --to the other so that the pressure points lie in the same plane as the remainder of the plastic body, each said pressure point--.

In column 3, claim 1, line 45, after "said bag crease" and before "tab,", please insert --opening wherein the bag folded end is adapted to fit under the--.

In column 3, claim 2, line 50, please delete "bag." and substitute therefor --bag,--.

In column 3, claim 2, line 61, please delete "griped" and substitute therefor --gripped--.

In column 3, claim 2, line 64, after "the pressure points" and before "and extending", please insert --and an area of larger width beyond the pressure points--.

In column 4, claim 3, line 10, please delete "location" and substitute therefor --locations--.

UNITED STATES PATENT AND TRADEMARK OFFICE

CERTIFICATE OF CORRECTION

PATENT NO. : 5,231,735
DATED : August 3, 1993
INVENTOR(S) : Jerre H. Paxton

It is certified that error appears in the above-indentified patent and that said Letters Patent is hereby corrected as shown below:

In column 4, claim 5, line 47, please delete "tow" and substitute therefor--two--.

Signed and Sealed this

Fifteenth Day of March, 1994

*Attest:*

*Attesting Officer*

BRUCE LEHMAN

*Commissioner of Patents and Trademarks*